US007886884B2

(12) United States Patent
King et al.

(10) Patent No.: US 7,886,884 B2
(45) Date of Patent: Feb. 15, 2011

(54) CARRY-ON LUGGAGE CASE

(75) Inventors: William L. King, Warren, RI (US); Charles Weisbart, Palm Desert, CA (US)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 198 days.

(21) Appl. No.: 10/589,632

(22) PCT Filed: Feb. 9, 2005

(86) PCT No.: PCT/US2005/004798

§ 371 (c)(1),
(2), (4) Date: Sep. 3, 2008

(87) PCT Pub. No.: WO2005/079619

PCT Pub. Date: Sep. 1, 2005

(65) Prior Publication Data

US 2009/0127046 A1 May 21, 2009

Related U.S. Application Data

(60) Provisional application No. 60/545,286, filed on Feb. 17, 2004.

(51) Int. Cl.
*A45C 5/14* (2006.01)
*A45C 13/02* (2006.01)

(52) U.S. Cl. ..... 190/109; 190/18 A; 190/111; 190/112; 190/903; 224/652

(58) Field of Classification Search ..... 190/18 A, 190/109–111, 112, 903; 383/907; 224/645, 224/652–655
See application file for complete search history.

(56) References Cited

U.S. PATENT DOCUMENTS 1,921,110 A * 8/1933 Wheary ..... 206/293
2,180,191 A 11/1939 Bauch (Continued)

FOREIGN PATENT DOCUMENTS

FR 2577773 A3 * 8/1986

OTHER PUBLICATIONS

International Search Report, PCT/US2005/004798, dated Jun. 6, 2005.

(Continued)

*Primary Examiner*—Sue A Weaver
(74) *Attorney, Agent, or Firm*—Dorsey & Whitney LLP

(57) ABSTRACT

Luggage cases that are sized and shaped to be carried on to the passenger compartment of a commercial airplane are called carry-on luggage cases. Cases small enough to fit below the passenger seat 28 immediately in front of the traveler must be very small and compact and generally interfere with comfortable placement of the passenger's feet during travel. The disclosed luggage case 2 includes a tapering reinforced portion 22 of the main packing door 18 on which a passenger may wish to place or rest his or her feet during travel. This main packing door 18 is constructed to bend and open to give access to a specially designed slanting shelf area 12 where a bottled drink 16 or cosmetics can be easily accessed without removing the case 2 from its stowed position beneath the front passenger seat 28.

5 Claims, 15 Drawing Sheets

U.S. PATENT DOCUMENTS

| | | | | | |
|---|---|---|---|---|---|
| 2,209,781 | A | | 7/1940 | Lewis | |
| 2,470,367 | A | | 5/1947 | Palma | |
| 2,718,943 | A | * | 9/1955 | Braverman | 190/107 |
| 2,985,265 | A | | 5/1961 | Gehrie | |
| 4,081,061 | A | | 3/1978 | Tucker | |
| 4,244,632 | A | * | 1/1981 | Molinari | 312/231 |
| 4,538,861 | A | * | 9/1985 | Hughes, Jr. | 312/244 |
| 5,004,134 | A | | 4/1991 | Barry | |
| 5,083,645 | A | | 1/1992 | Lee | |
| 5,295,565 | A | * | 3/1994 | Latshaw | 190/18 A |
| 5,407,112 | A | | 4/1995 | Christodoulou et al. | |
| 5,515,954 | A | | 5/1996 | Nordstrom | |
| D374,773 | S | | 10/1996 | Domotor | |
| 5,560,483 | A | * | 10/1996 | Sequin | 206/278 |
| 5,630,521 | A | | 5/1997 | Waddell et al. | |
| 5,671,831 | A | | 9/1997 | Chiu | |
| 5,676,223 | A | | 10/1997 | Cunningham | |
| D387,198 | S | | 12/1997 | Lehmann et al. | |
| 5,788,032 | A | * | 8/1998 | Krulik | 190/108 |
| 5,875,876 | A | | 3/1999 | Wang | |
| 5,944,155 | A | | 8/1999 | Geary | |
| 5,984,154 | A | | 11/1999 | Scicluna | |
| 6,109,403 | A | | 8/2000 | Godshaw | |
| D431,903 | S | | 10/2000 | Worley | |
| 6,213,267 | B1 | | 4/2001 | Miller | |
| D459,579 | S | | 7/2002 | Kegels | |
| 6,431,334 | B1 | | 8/2002 | Lin | |
| 6,467,594 | B1 | | 10/2002 | Wu | |
| 6,547,070 | B1 | * | 4/2003 | Kolpin | 206/317 |
| 6,604,617 | B2 | | 8/2003 | Davis et al. | |
| D485,681 | S | | 1/2004 | Fenton et al. | |
| 2002/0108828 | A1 | | 8/2002 | Soskin | |
| 2003/0015559 | A1 | * | 1/2003 | Oh | 224/153 |
| 2009/0008203 | A1 | | 1/2009 | King et al. | |
| 2009/0050429 | A1 | * | 2/2009 | Adams, Jr. | 190/109 |

OTHER PUBLICATIONS

Notice of Allowance, U.S. Appl. No. 10/589,631, dated May 24, 2010.

Response to Office Action, U.S. Appl. No. 10/589,631, dated Mar. 30, 2010.

Office Action, U.S. Appl. No. 10/589,631, dated Sep. 30, 2009.

Notice of Allowance, U.S. Appl. No. 10/589,631, dated Jun. 29, 2010.

* cited by examiner

CARRY-ON LUGGAGE CASE

BACKGROUND OF THE INVENTION

This invention relates to softside luggage case construction, specifically luggage cases sized to be carried on into the cabin of a commercial aircraft by the traveler. More specifically, this invention relates to luggage cases sized to fit beneath the aircraft seat directly in front of the passenger. In many instances the traveler has no choice but to place his or her carry-on luggage in the extremely restricted space beneath the passenger seat immediately in front of the traveler. This space must also accommodate the feet of the passenger. For tall passengers, this is a major problem. The passenger must put his or her feet on either side of the carry-on luggage case stowed in this precious space or place his or her feet on the case itself. For shorter passengers, it is often an advantage to have carry-on luggage on which to place ones' feet to create a comfortable position and to rest ones' feet or legs.

It is an object of this invention to accommodate both or all passengers to optimize the use of the space below the seat immediately forward of the passenger, as well as to accommodate bottles and containers that may otherwise more easily spill by providing a shelf space within this carry-on sized luggage case to position a bottle or container at about 45° from a horizontal plane, whether the case is in the stowed position (that is, lying down) below the mentioned passenger seat or standing erect on its wheels and/or glides as when the case is being towed or wheeled on the provided wheels typical for such luggage cases.

DETAILED DESCRIPTION OF THE PREFERRED EMBODIMENT

Figure 11C:
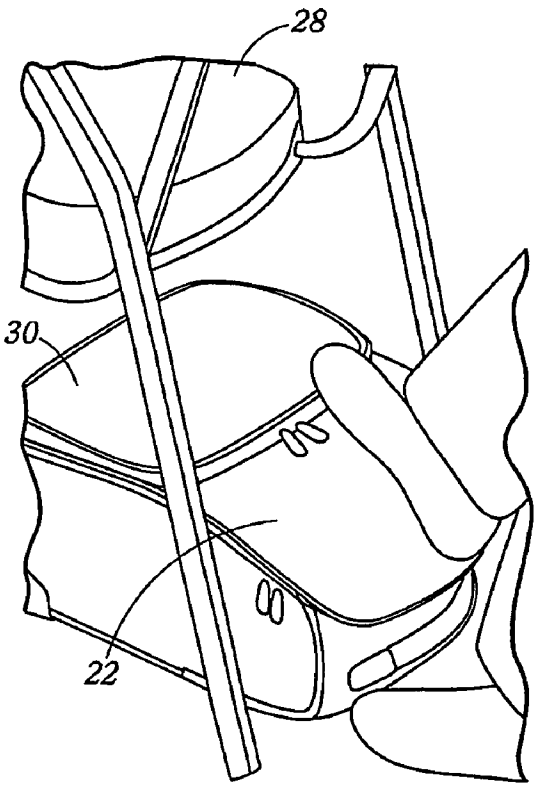
FIGS. 11 A, B, and C illustrate three conditions of use that take advantage of the innovative features of this preferred embodiment.
Figure 11B:
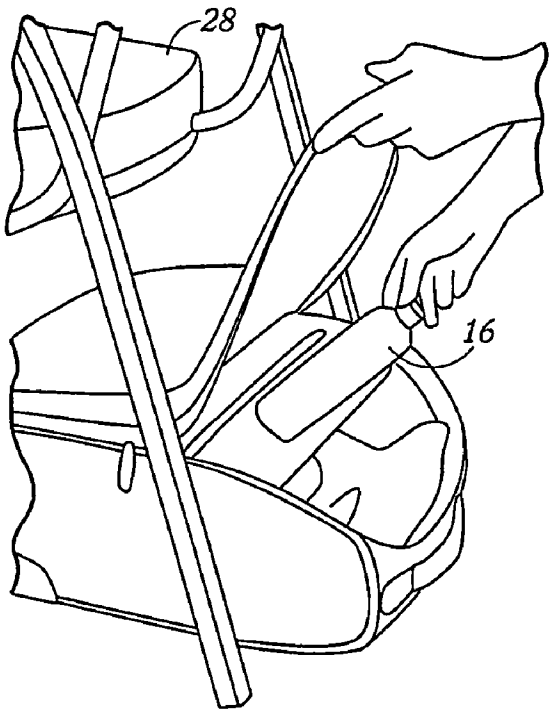
Figure 11A:
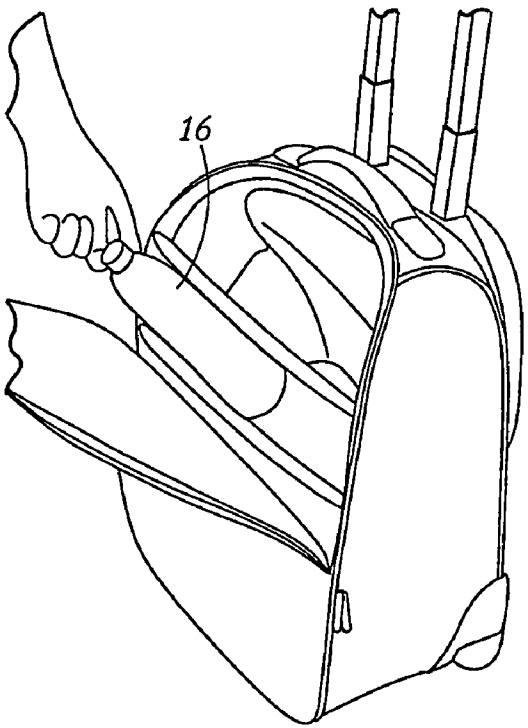

The case 2 is constructed in the known manner using a fabric, preferably textile fabric, outer covering. Plastic sheets 4 stabilize the overall shape of the case 2 and conventional wheels 6 and carry handle 8 and/or towing handle (not shown) permit the case to be towed on a pair of corner mounted wheels 6 as shown in the figures. Wheels 6 could comprise castor wheels. Inside the case 2 there is a specially designed organizing feature 12, specifically one and preferably two stiffened dividers 14 which are mounted at approximately 45° from the horizontal or stowed position (FIGS. 11B and C for example) as well as 45° from the vertical position (when the case 2 stands on its wheels 6 and glides 7 as in FIG. 11A for example). These dividers 14 help support and position one or more containers 16, such as containers 16 used to hold liquid refreshment during a flight, cosmetics, snacks, medication bottles and the like. Of course, it should be understood by one of ordinary skill in the art that case 2 can comprise any type of storage and/or transport vessel, including backpacks, messenger bags, totes, purses, briefcases, or any other type of storage and/or transport device. Case 2 may be manufactured with the exclusion of wheels and can be transported by any other mechanism including shoulder straps, backpack straps, carry-handles, or other transport device.

Figure 1:
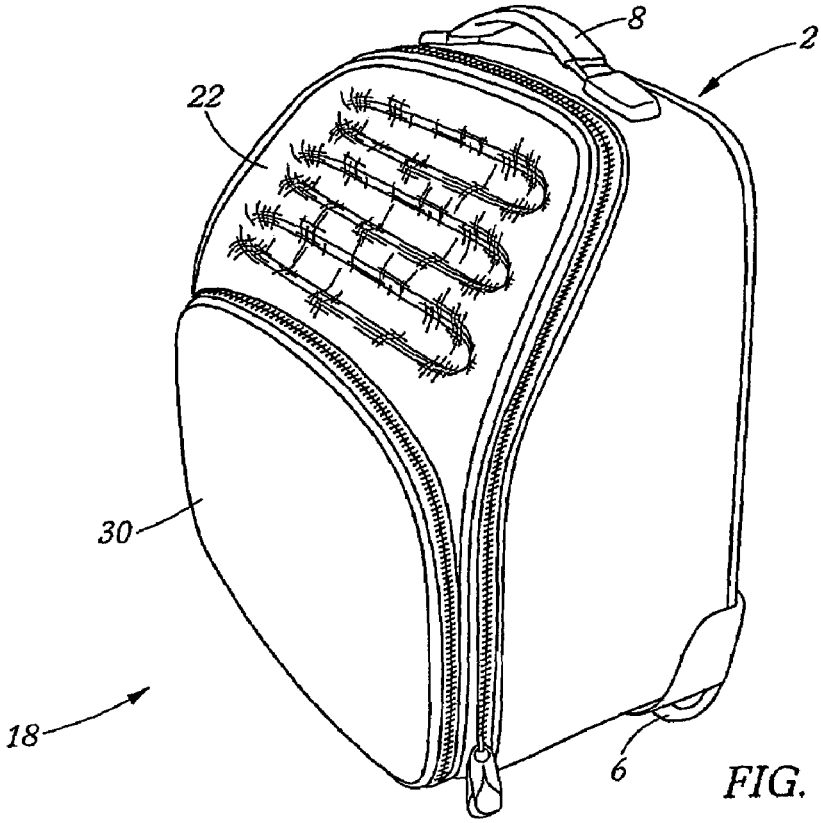
FIG. 1 is a perspective view of the luggage case according to this invention.
Figure 2:
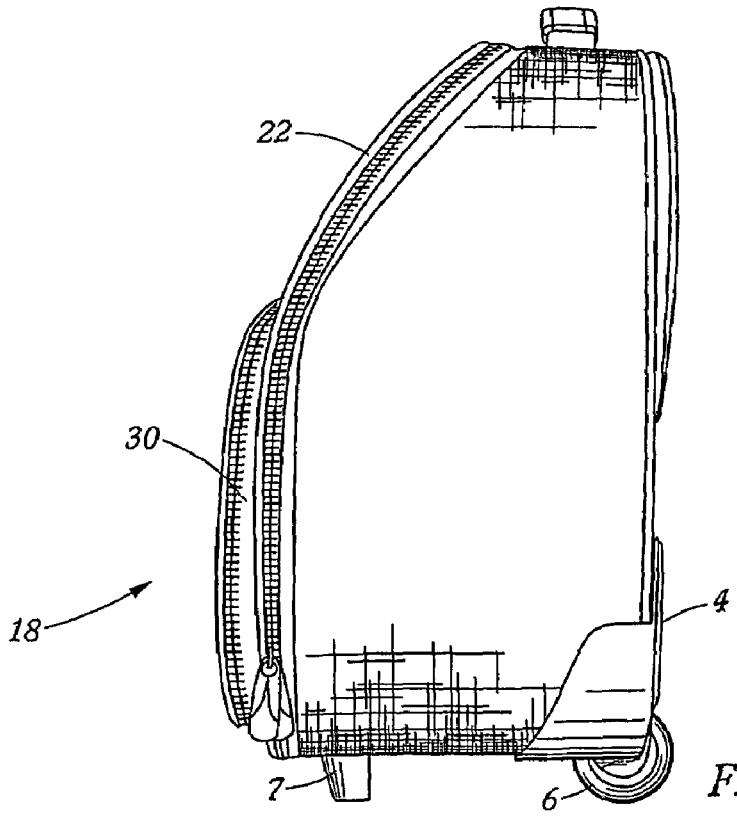
FIG. 2 is right side view thereof.
Figure 3:
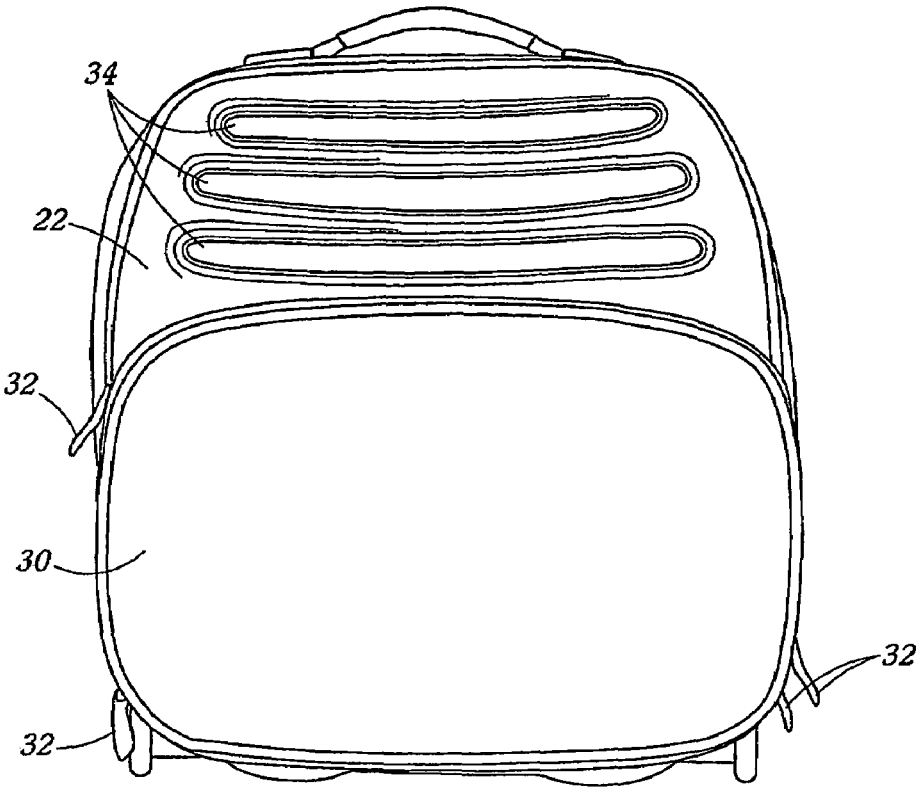
FIG. 3 is a front view thereof.
Figure 8:
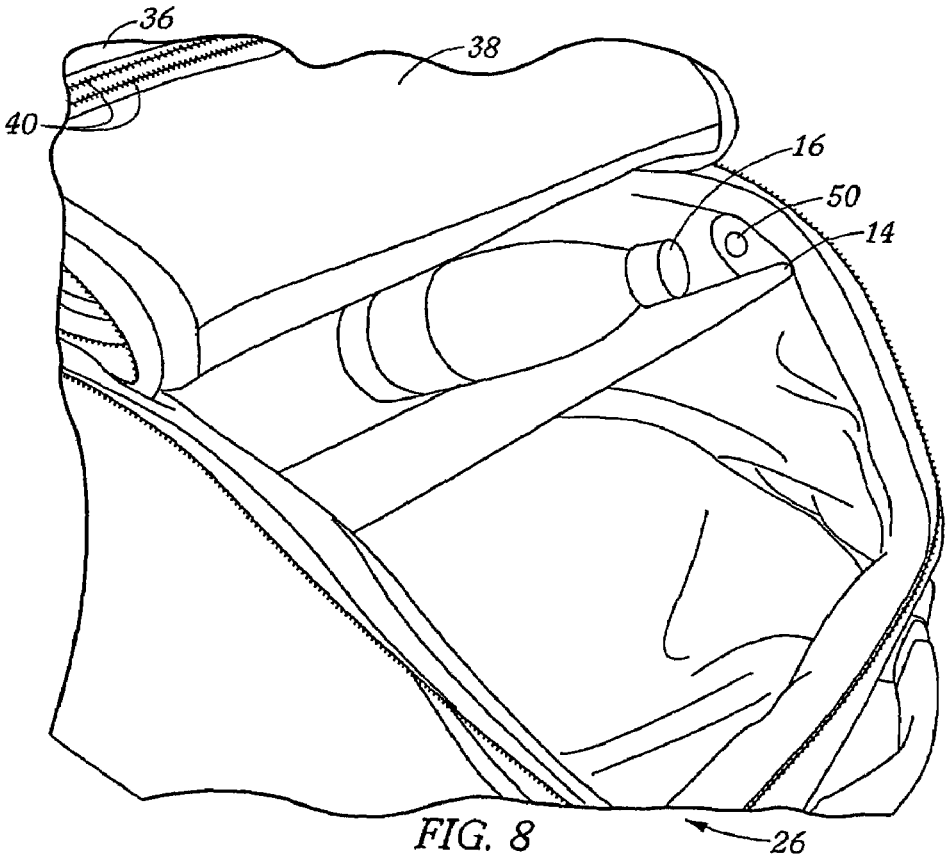
FIG. 8 is a closer view thereof.
Figure 9:
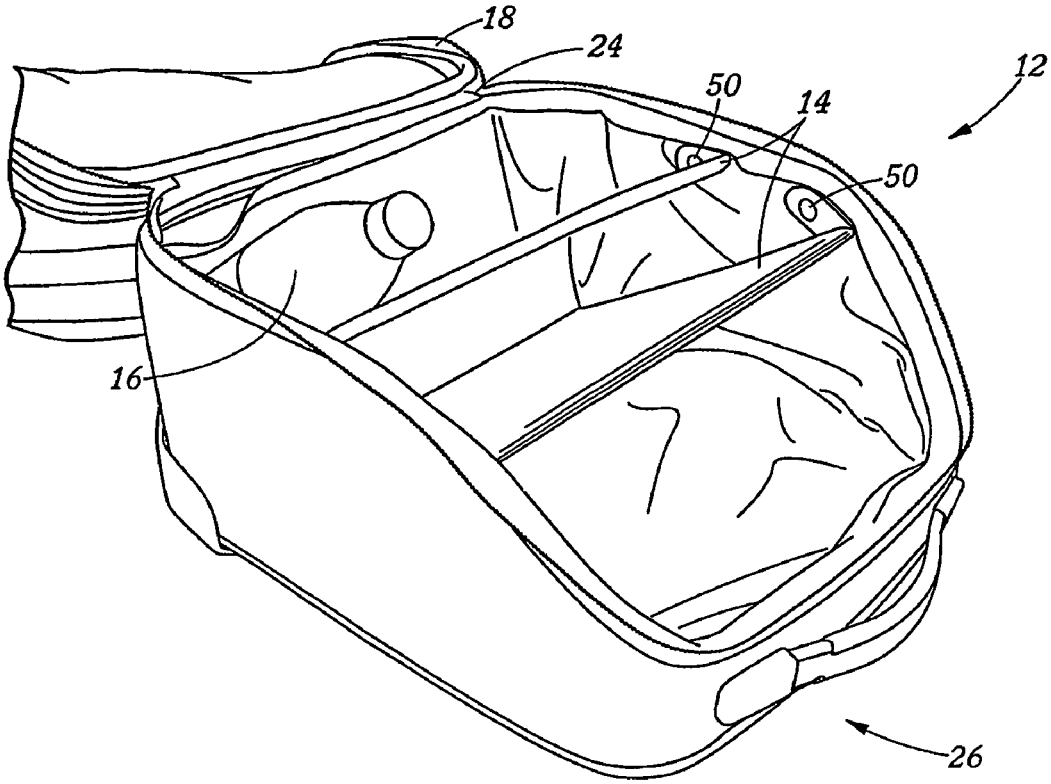
FIG. 9 is a similar view with the self-hinging zip door fully open to expose the entire main packing compartment.
Figure 10:
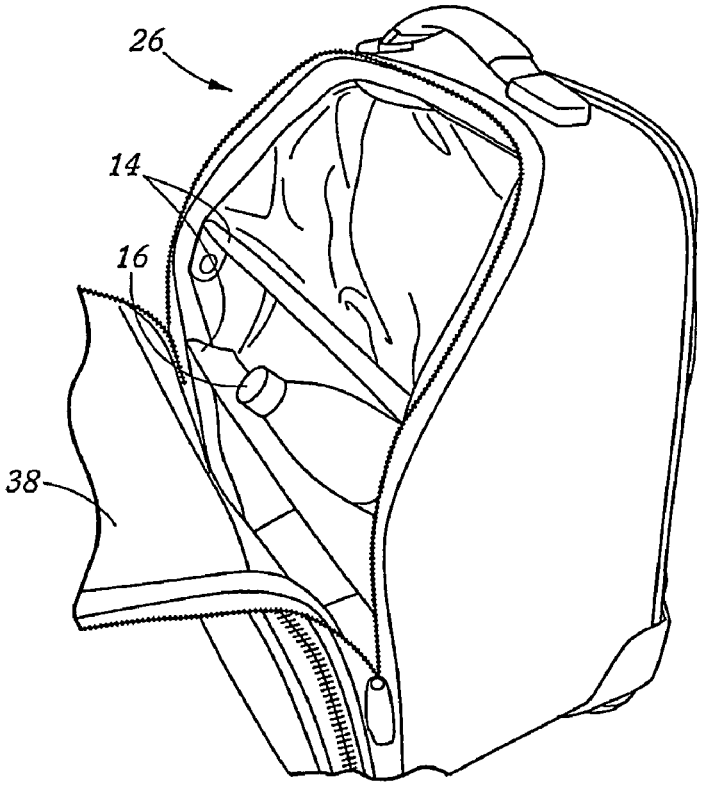
FIG. 10 shows the case in a similar configuration to FIG. 8 but with the case in a vertical position.

The main packing door 18 of the case 2 has a special construction and operation, as can be seen in the figures. This packing door 18 preferably extends the entire front face of the luggage case 2 and is generally constructed in two sections. The first section follows a generally tapering side shape. This tapering portion or surface 22 has a stiffening polyethylene panel to permit it to help resist crushing or permanent bending when the passenger's feet are placed on these surfaces. The packing door 18 also has a flexible hinge portion 24 connecting this tapering portion 22 with the rest of the main packing door 18. This permits this door 18 to be flipped open as shown in FIG. 8 to permit access to the 45°-mounted slanting shelf area, created by dividers 14, within the main packing compartment 26. Thus, access can be had without removing the case 2 from its stowed position beneath the passenger seat 28 immediately in front of the traveler. The rest of the main packing door 18 is constructed of layers of textile fabric on the inside and outside and preferably includes another small compartment 30 with zipper access 32 (see FIG. 2). Small compartment 30 includes inner pouches of various materials and sizes. Otherwise the construction of the case 2 is typical and construction techniques are well known throughout the luggage industry, using polyethylene sheet to give resilient stiffness to the overall door 18. Preferably, at least the tapering portion 22 of the door 18 further includes a layer of foam padding with a pleasing texture or ribs 34 sewn or molded in to permit a comfortable rest for the stocking feet of the traveler.

Figure 4:
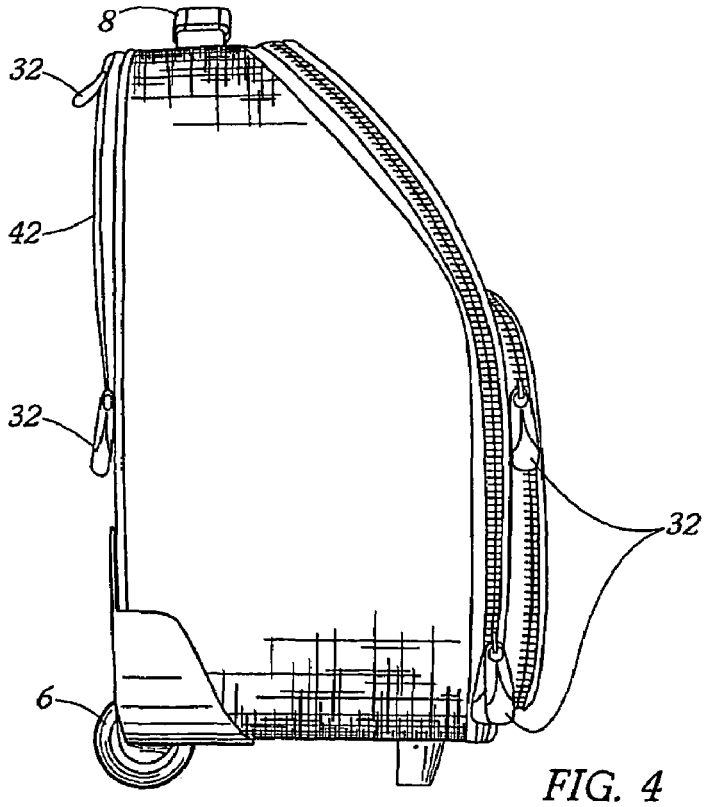
FIG. 4 is the left side view thereof.
Figure 5:
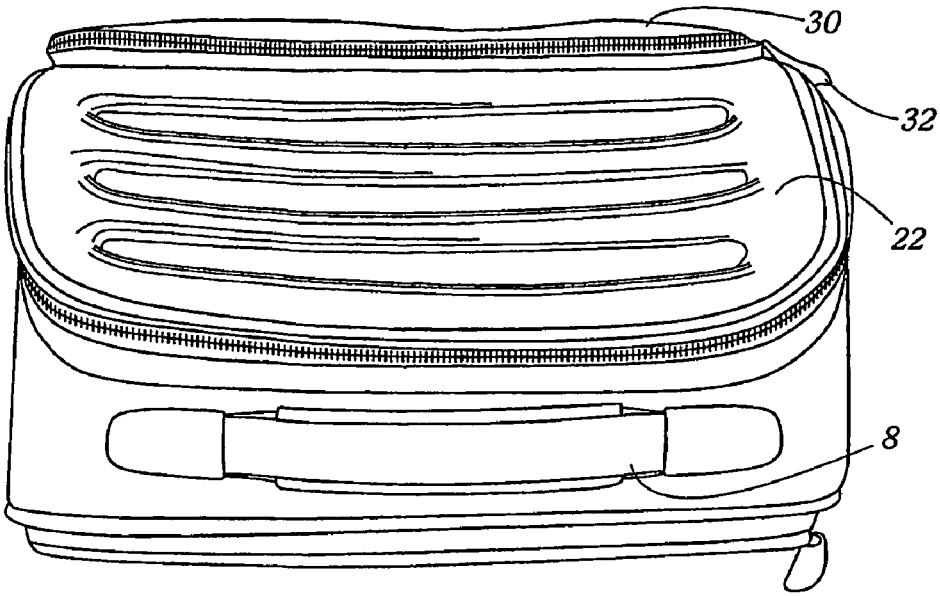
FIG. 5 is a top view of the luggage case.
Figure 6:
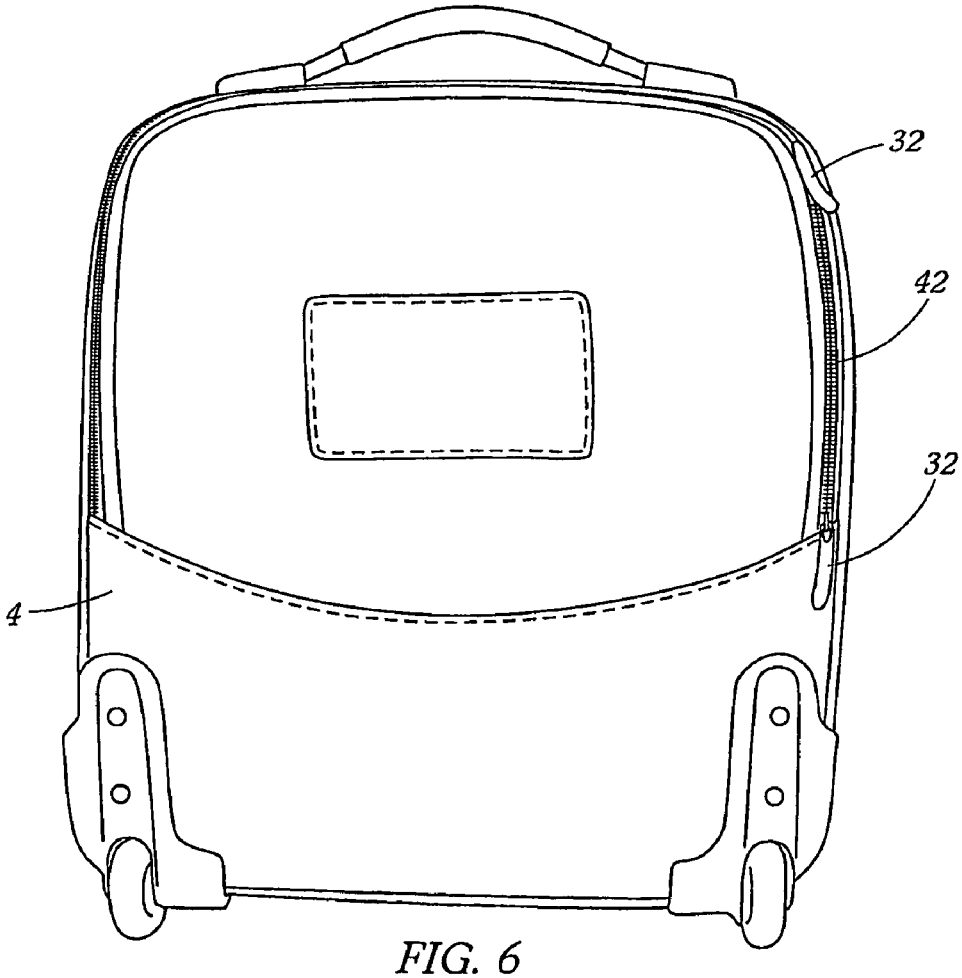
FIG. 6 is a back view thereof.
Figure 7:
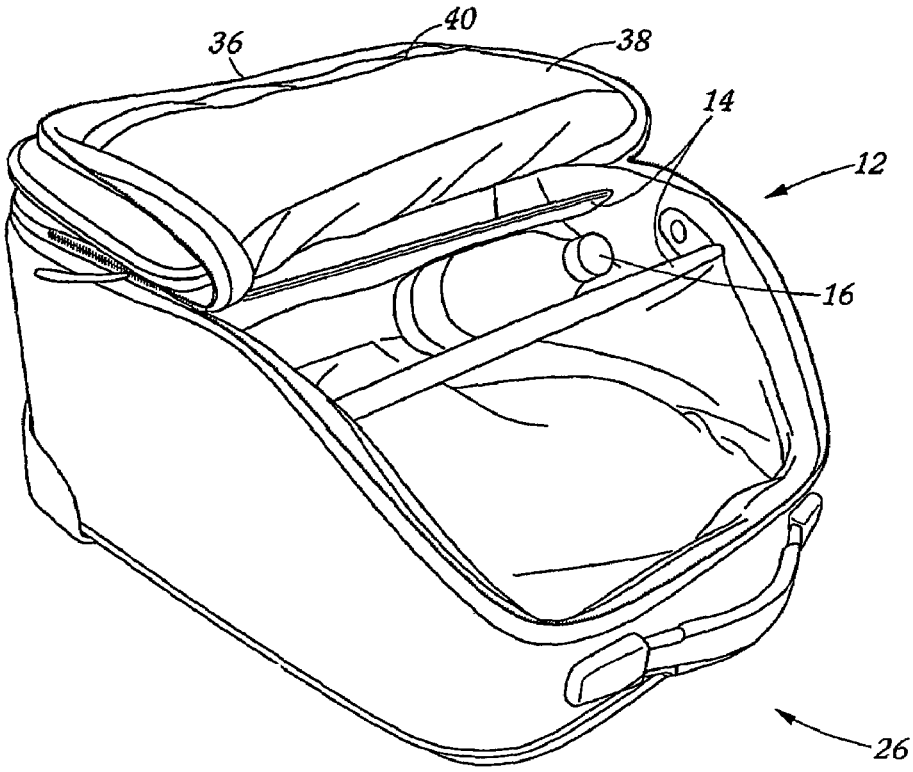
FIG. 7 is a view of the carry-on case in its stowed position with the flexible lid portion open to expose the specially slanted shelf arrangement.

The main packing door 18 may also comprise on its inner surface an upper pocket 36 and a lower pocket 38. Upper and lower pockets 36 and 38 may comprise any shape or depth, and may comprise any material including solid textile or mesh material. Pockets 36 and 38 may be open pockets or they may be closed by zippers 40. Main packing door 18 defines main packing compartment 26 and is secured by zipper 32. Referring to FIG. 4, towing handle is concealed by back pouch 42. Back pouch 42 is surrounded by zippers 32 and may accommodate packed items of the user. Back pouch 42 may vary in size and shape and may include a multitude of additional inner pouches.

Figure 12:
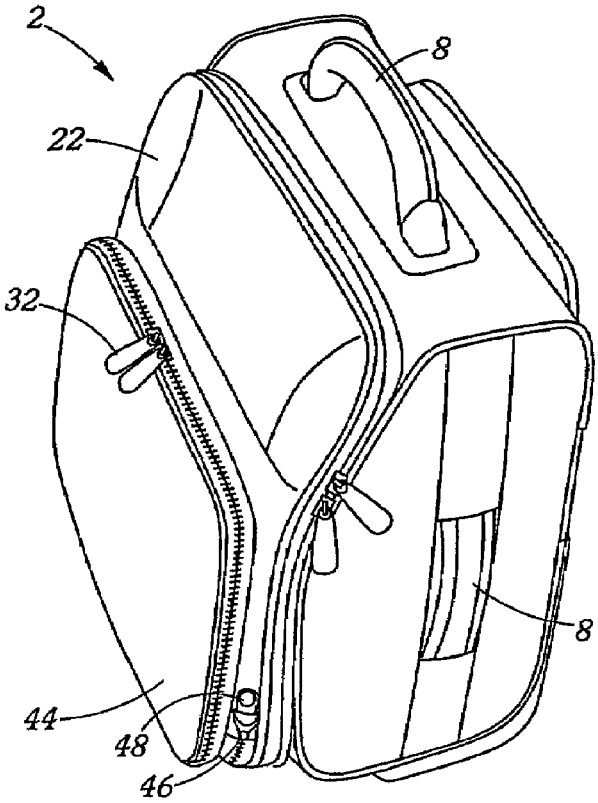
FIG. 12 is a perspective view of a second embodiment of the present invention including a dually accessible compartment that can be opened from a top side or a bottom side.

FIGS. 12 through 25 illustrate a second embodiment of the present invention. An advantage of the present invention is a dually accessible compartment 44 that is shown in closer detail in FIG. 19. As shown in FIG. 12, the luggage case 2 can comprise all of the above-mentioned features in a variety of visual manifestations. For example, tapered portion 22 can also be defined by a padded front panel as shown in FIGS. 12 through 25. Tapered portion 22 is tapered such that not only does case 2 fit comfortably underneath the forward passenger seat 28, but also neatly resides in the overhead compartment by shoving the case 2 tapered-end first into the overhead bin. The contents of case 2 can be accessed while the case 2 is stowed in the overhead compartment by opening a bottom zipper 46 that defines dually accessible compartment 44. Thusly, dually accessible compartment 44 can be accessed from the bottom by opening bottom zipper 46, or accessed from the top when in an upright position, by opening zipper 32. A securing feature 48 is provided to lock bottom zipper 46 in place, helping to remind the user to secure the contents of dually accessible compartment 44 while the case 2 is being towed or stored upright. In this embodiment of the present invention, securing feature 48 comprises a hook and snap mechanism. Of course, other securing mechanisms may be used to secure the bottom zipper 46. Such securing mechanisms may include hook and loop fasteners, buttons, slots and straps, or any other securing mechanism. Dually accessible compartment 44 includes additional pouches of various sizes and material.

Figure 19:
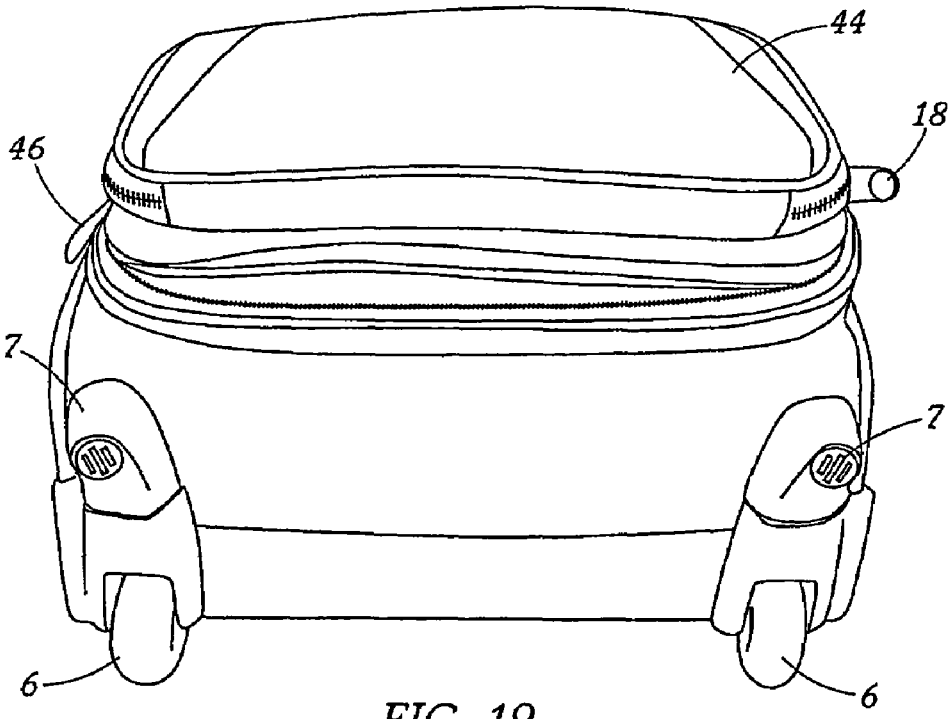
FIG. 19 is a closer view of the dually accessible compartment.
Figure 20:
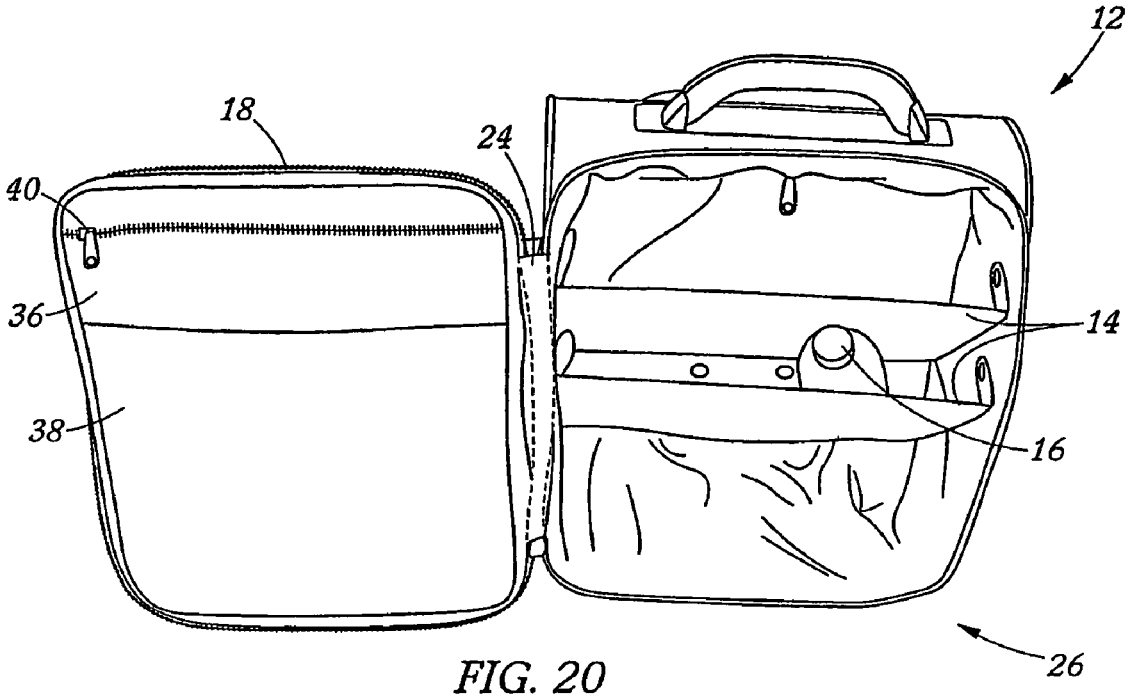
FIG. 20 shows the luggage case in an upright position with the main packing door open and hinged from the side.
Figure 21:
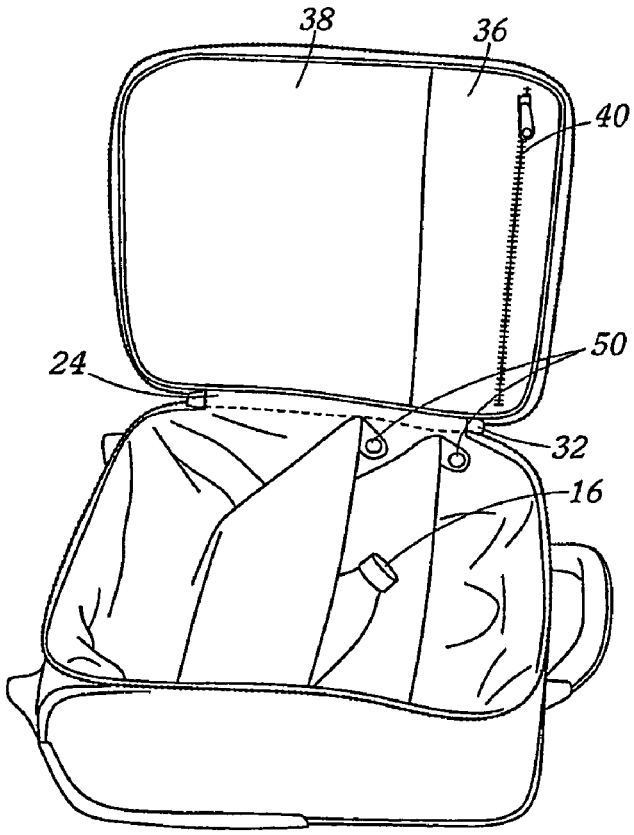
FIG. 21 is a closer view thereof.
Figure 22:
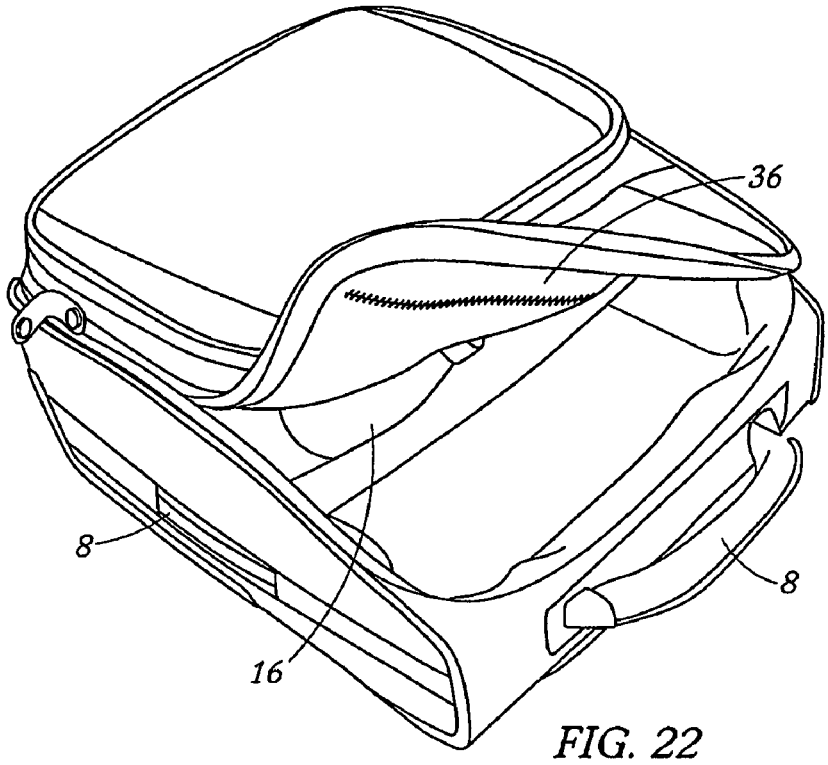
FIG. 22 is a closer view of the main packing door showing how the main packing compartment can be easily accessed even when the carry-on is in a stowed position.
Figure 23:
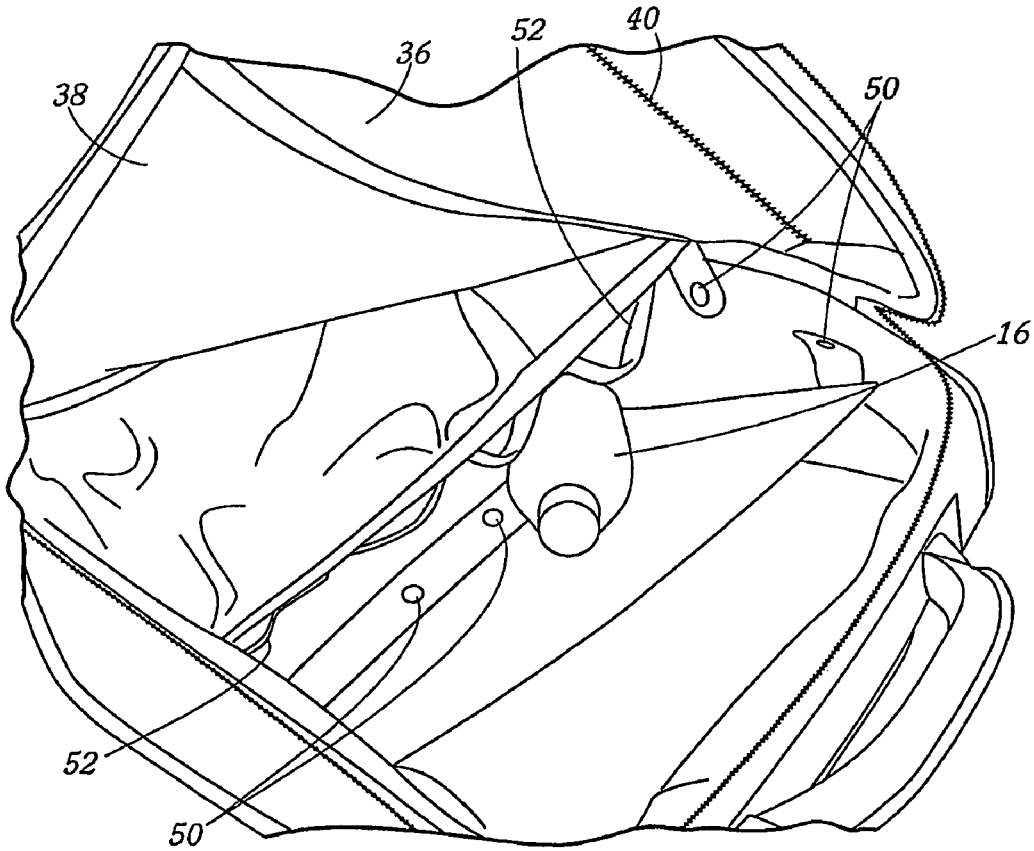
FIG. 23 is a close up view of an organizing feature within the main packing compartment.
Figure 24:
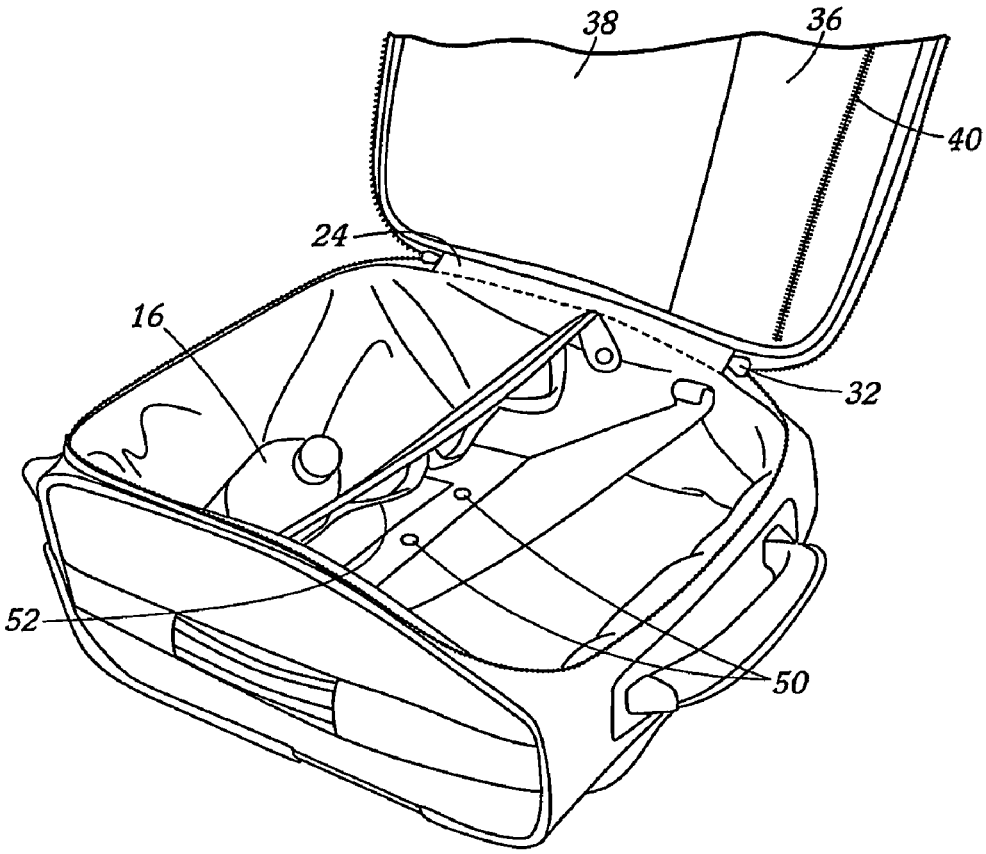
FIGS. 24 and 25 show the case in a stowed and upright position respectively.
Figure 25:
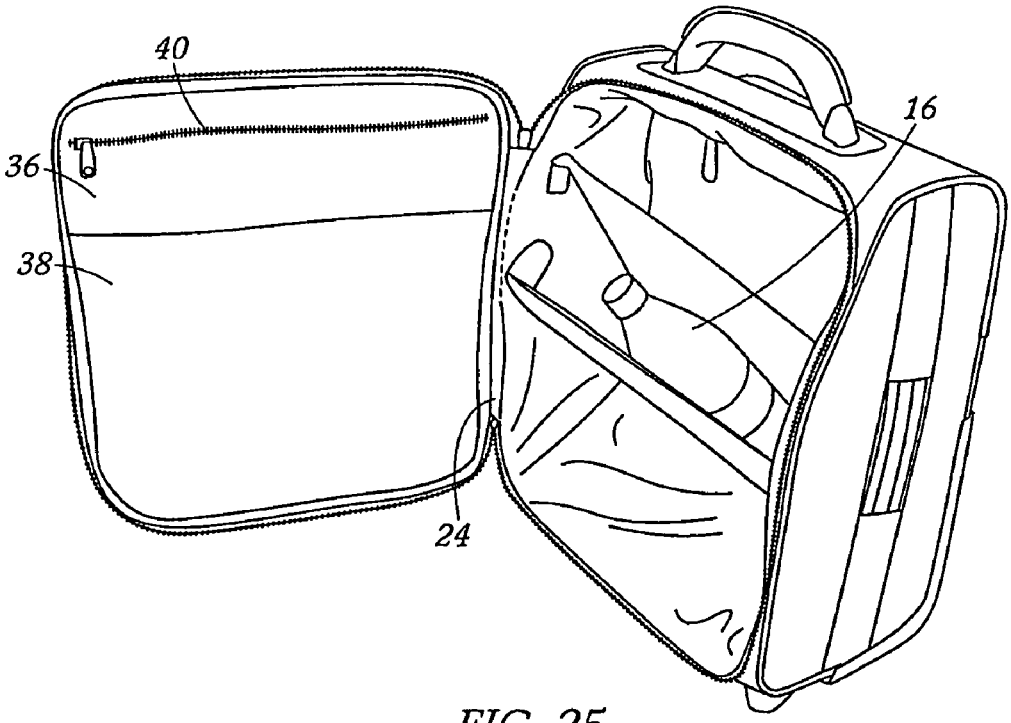
Figure 26:
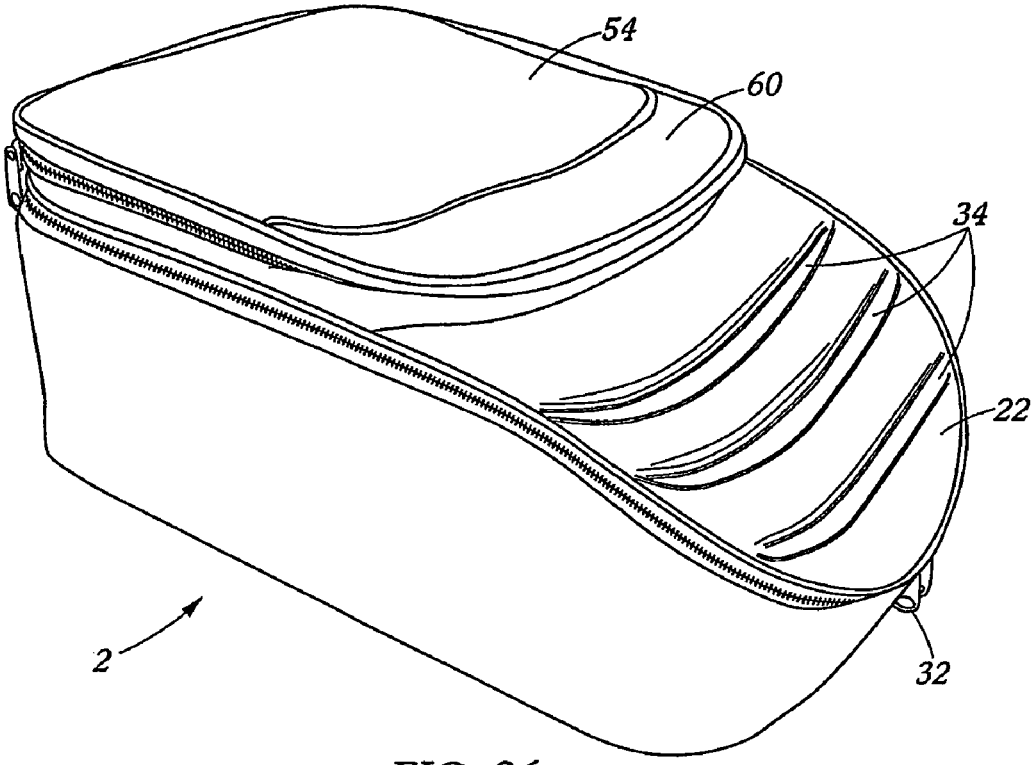
FIGS. 26 through 29 illustrate another embodiment of the present invention.
Figure 27:
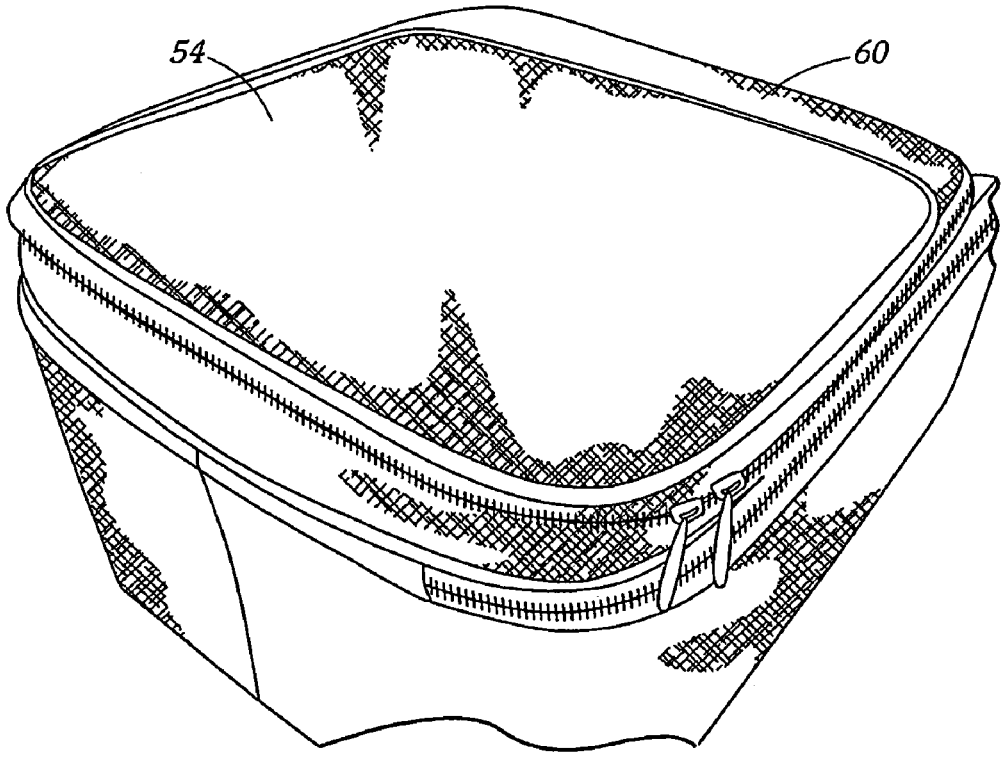

FIG. 19 illustrates a close up view of the accessibility of dually accessible compartment 44. Case 2 can be stored underneath the forward passenger seat 28 with tapered portion 22 facing the passenger, or with the bottom opening of the dually accessible compartment 44 facing the passenger. In either configuration, the contents of the present invention are much more easily accessible than those contents store in a conventional carry-on.

Figure 13:
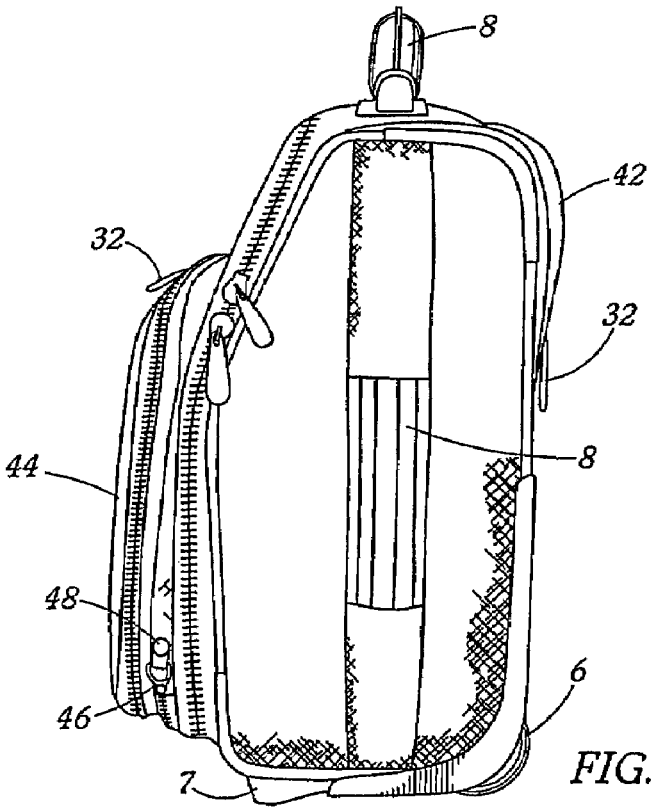
FIG. 13 is a right side thereof.
Figure 14:
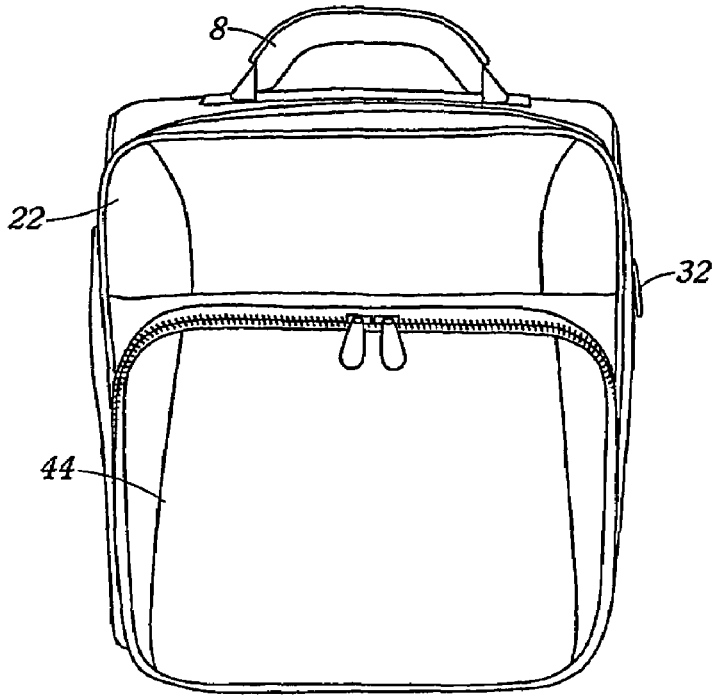
FIG. 14 is a front view thereof.
Figure 15:
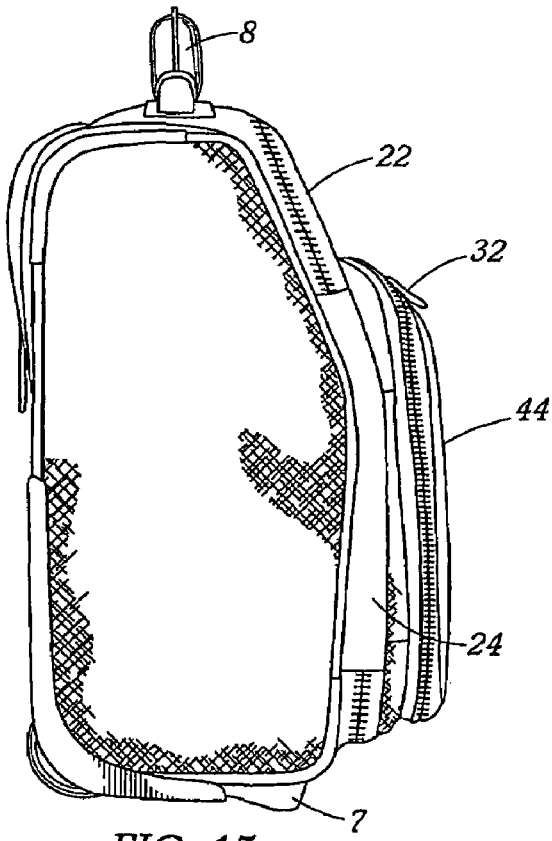
FIG. 15 is the left side view thereof.
Figure 16:
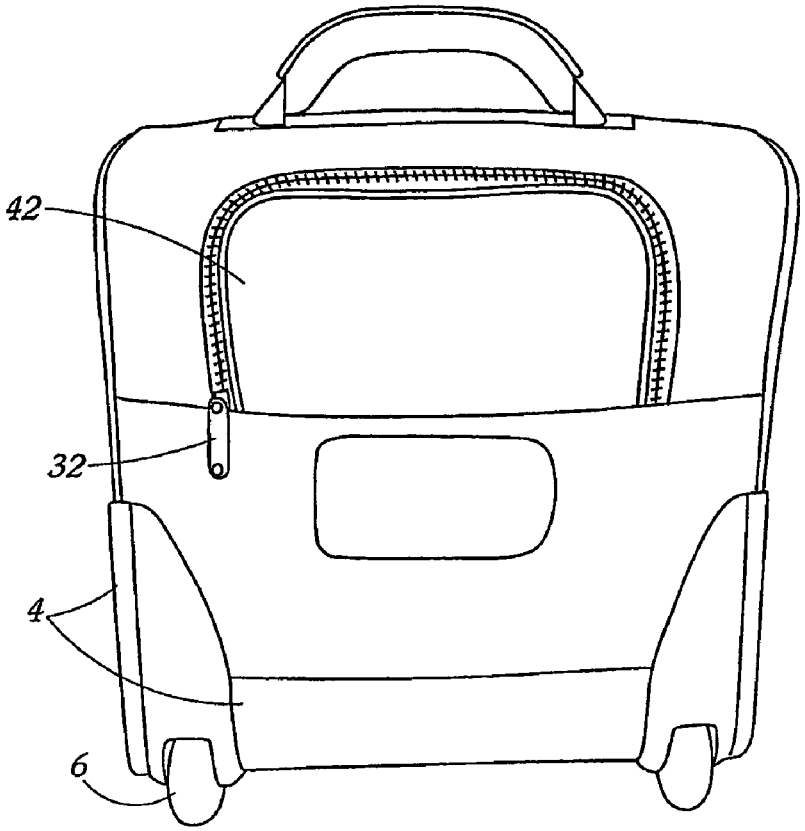
FIG. 16 is a back view thereof.
Figure 17:
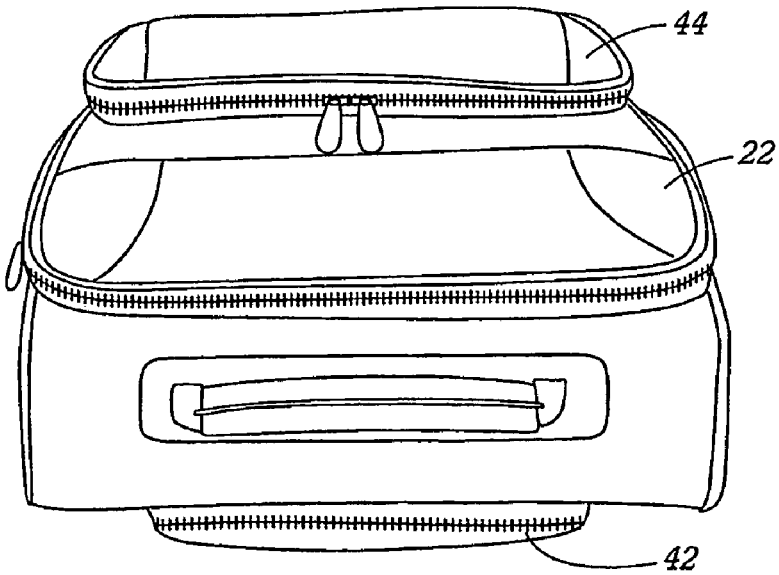
FIG. 17 is a top view of the luggage case.
Figure 18:
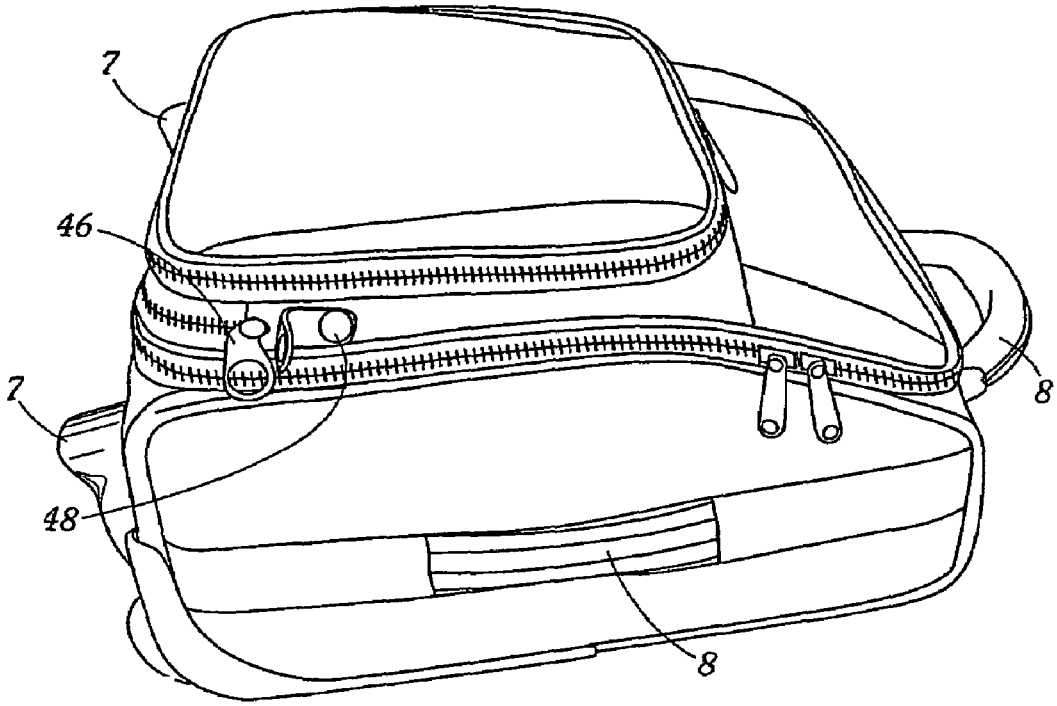
FIG. 18 is a view of the carry-on case as it would appear in a stowed position either underneath a passenger seat or in an overhead compartment.

As shown in FIG. 13, a second carry handle 8 is provided on the right side of case 2. In this embodiment of the present invention, the main packing door 18 is self-hinged from the side of case 2. It should be understood by one of ordinary skill in the art that the length and position of hinge 24 can vary. For example, side hinge 24 could be shorter, so that main packing door 18 could still be easily bent back by a passenger while the case 2 is stored under the forward passenger seat 28. The passenger would need only slightly open zipper 32. Of course, the location of the main packing door hinge 24 can be moved any where along case 2. For example, main packing door 18 can be hinged from the bottom as discussed previously with regard to the descriptions of FIGS. 1 through 12. Conversely, hinge 24 could be positioned on a corner allowing main packing door 18 to be opened horizontally.

As shown in FIGS. 20 through 25, this second embodiment of the present invention incorporates organizing feature 12. The organizing feature comprises one modular unit that includes a shelf area created by dividers 14. This unique shelving area allows items such as water bottles 16 to remain slightly upright whether the case itself is laying down or upright. In all embodiments of the present invention, the organizing feature 12 may be removable from case 2, or it may be fixed permanently within the case 2. Organizing feature 12 could be sewn into the case 2, or attached by other means including glue, staples, pins, etc. Additionally, dividers 14 may be individually removed from either a permanent or removable organizing feature 12. Organizing feature 12 may incorporate a slot (not shown) to accommodate the mechanism of the towing handle (not shown). Organizing feature 12 is attached to the main packing compartment 26 by a system of snaps 50. Of course, other mechanisms could be used to detachably affix the organizing feature 12 to main packing compartment 26, including hook and loop fasteners and so on. Snaps 50 are sewn to the sides and/or bottom of organizing feature 12 and attach to mating eyes (not shown) that are sewn onto the material of the main packing compartment 26. Dividers 14 include elastic strips 52 to further secure personal items in an upright position. Any other securing methods could be incorporated into dividers 14. Such mechanisms may include basting, pouches, etc.

Figure 28:
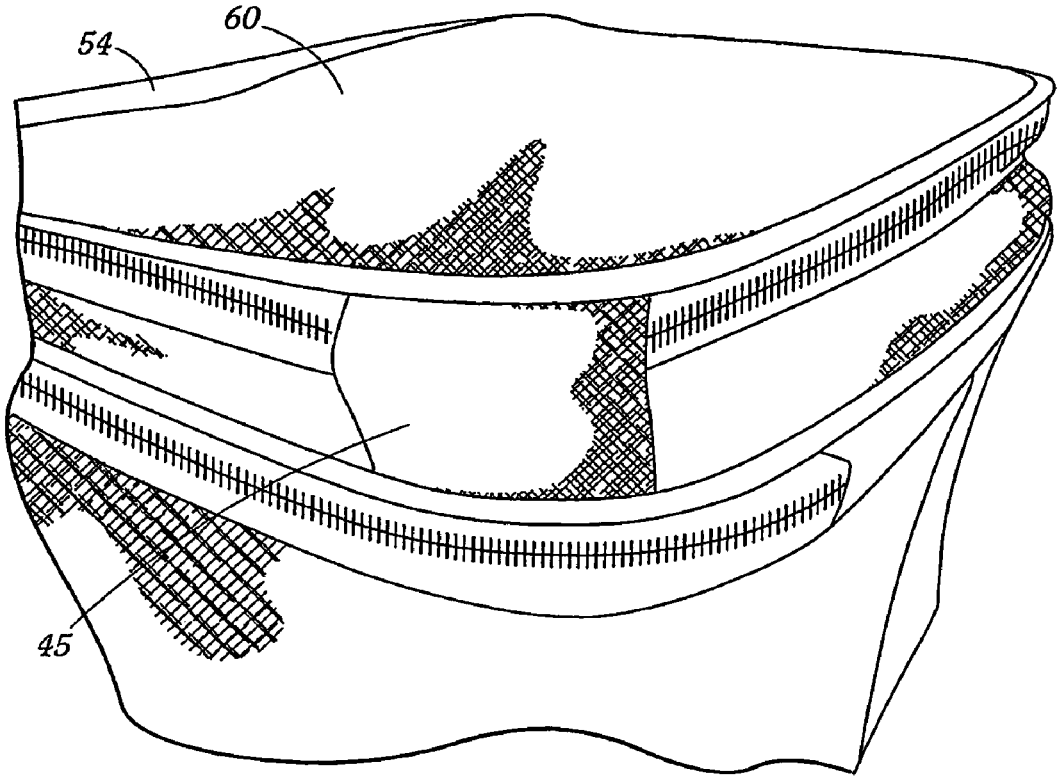
Figure 29:
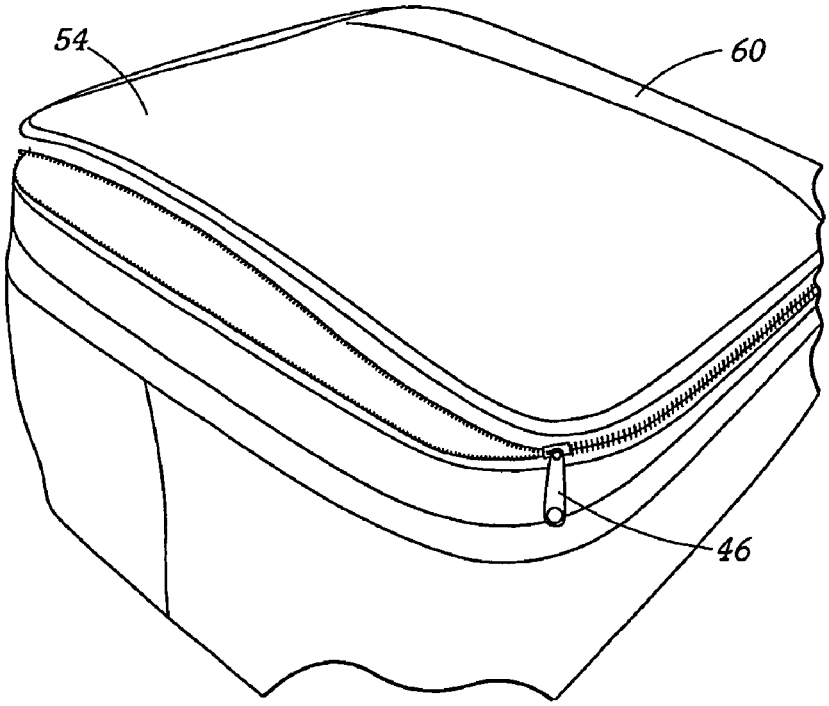

FIGS. 26 through 29 illustrate a third embodiment of the present invention. The case shown in FIGS. 26 through 29 incorporates features of both the first and second embodiments. The case 2 in these figures incorporates a tapered portion 22 that also includes ribs 34. Case 2 further includes an all-sided accessible compartment 60. Referring to FIG. 28, all-sided accessible compartment 60 is defined by a self-hinging textile panel 45 that is approximately 2 inches in length. Self-hinging textile panel 45 is affixed directly to the textile panel that defines all-sided accessible compartment 60. This minimal hinge connection 45 permits access to the interior of all-sided accessible compartment 60 from all normal sides of the compartment including a top side, both the vertical sides, and from the bottom side as well. This valuable feature permits the traveler to store case 2 in any location on an aircraft, including an overhead compartment, the space below a passenger seat, or other location, while still being able to access the contents of all-sided accessible compartment 60 without having to remove the case 2 from its place. Of course, the sides of all-sided accessible compartment 60 may include a folding gusset panel (not shown). In addition, a mini compartment 54 is included in which a passenger may store essential items.

The present invention therefore provides a method and system for easily accessing items stored in a stowed case 2 by including a tapered portion 22, a smartly placed door hinge 24, and a dually accessible compartment 44.

Although the present invention has been described with a certain degree of particularity, it is understood that the present disclosure has been made by way of example, and changes in detail or structure may be made without departing from the spirit of the invention as defined in the appended claims.

We claim:

1. A carry-on luggage case having a tapered upper portion that comprises within a main packing compartment a unit comprising relatively stiff dividers that remain at a substantial angle to a horizontal plane when said luggage case is laying down and when said luggage case is standing in an upright position, said luggage case further comprising a dually accessible pouch having a top edge near the tapered upper portion and a bottom edge, the pouch including a zipper access opening configured such that it can be opened along the top edge of said pouch or along a bottom edge of said pouch to access items in the pouch, the zipper access opening further including a securing device that maintains the the zipper access opening closed along the bottom edge of the pouch while permitting access to the items in the pouch through the zipper access opening along the top edge of the pouch so that items are not lost when the case is shifted from a resting position to an upright position.

2. The carry-on luggage case of claim 1 wherein said unit is removable.

3. The carry-on luggage case of claim 1 wherein said tapered portion further comprises texture on an outside surface of said tapered portion for the comfort of a passenger's socked feet resting thereupon when said case is being stowed under a passenger's seat.

4. The carry-on luggage case of claim 1 further comprising a handle and wheels for ease of transportation.

5. The carry-on luggage case of claim 4 wherein said wheels are castor wheels.

* * * * *